US005804138A

United States Patent [19]

Earlam

[11] Patent Number: 5,804,138

[45] Date of Patent: Sep. 8, 1998

[54] FLUX FOR FIRE PREVENTION IN MAGNESIUM

[75] Inventor: Matthew R. Earlam, Lake Jackson, Tex.

[73] Assignee: The Dow Chmical Company, Midland, Mich.

[21] Appl. No.: 885,787

[22] Filed: Jun. 30, 1997

[51] Int. Cl.[6] ..... C22C 22/00

[52] U.S. Cl. ..... 420/402; 148/420; 148/23; 148/26

[58] Field of Search ..... 148/420, 23, 26; 420/402

[56] References Cited

U.S. PATENT DOCUMENTS

| | | | |
|---|---|---|---|
| 2,327,153 | 8/1943 | Nawhams et al. . | |
| 4,368,371 | 1/1983 | Dilthey et al. | 148/26 |
| 4,384,887 | 5/1983 | Skach et al. | 75/358 |
| 5,676,774 | 10/1997 | Setzer et al. | 148/538 |

FOREIGN PATENT DOCUMENTS

| | | |
|---|---|---|
| 1641368 | 4/1991 | U.S.S.R. . |

*Primary Examiner*—John Sheehan

[57] ABSTRACT

A composition of matter suitable for use as a protective flux in the production of magnesium metal and magnesium-containing alloys is disclosed. The composition comprises 70 to 80 percent by weight KCl, and 20 to 30 percent by weight $MgCl_2$ and up to 0.5 percent by weight $CaF_2$.

9 Claims, No Drawings

FLUX FOR FIRE PREVENTION IN MAGNESIUM

The present invention relates to a new composition of matter suitable for use as a protective flux in the production of magnesium metal and magnesium-containing alloys.

BACKGROUND AND SUMMARY OF THE INVENTION

Magnesium metal is typically formed by electrowinning a molten salt at a temperature of about 700° C. The metal is collected and then transported in metal transfer crucibles. Since the melting point of the metal is 650° C. It is necessary to transfer the metal at or about 680° C., to insure that the metal will have enough superheat to prevent freezing in the subsequent casting operations. Magnesium metal has the tendency to burn in air at temperatures over 450° C. Thus the metal is subject to burning if the transfer crucibles are not well sealed to prevent contact with air. When magnesium burns, slag is formed, resulting in a loss of metal. Accordingly, since the production of magnesium is typically carried out at temperatures and under conditions which promote the burning of the metal, and since the burning results in a loss of metal, methods of deterring the metal from burning are sought.

One way to prevent this burning of the metal is to cover the free surface of the metal with a protective flux, as is known in the industry. A number of fluxes have been tried, but are not entirely effective. Most known fluxes are more dense than the molten magnesium causing them to sink, thereby exposing the surface of the magnesium metal to the air. For example, it has been observed that the commercial flux M-130 (SRC-Rossborough) protects magnesium metal for only about 2 minutes in a 6000 pound pot, and after this time the flux sinks, allowing the metal to burn.

The present invention comprises a new composition which is particularly well suited for use as a flux in the production of magnesium metal or magnesium-containing alloys. The composition comprises 70 to 80% KCl and 20 to 30% $MgCl_2$. The composition may also preferably include 0 to 0.5% $CaF_2$. Compositions according to the present invention offer the advantages in the production of magnesium of having a lower melting point than magnesium and a lower density than magnesium.

DETAILED DESCRIPTION OF THE INVENTION

The composition of the present invention comprises 70 to 80% by weight KCl and 20 to 30% by weight $MgCl_2$. It is preferred that the composition comprises 75 to 80% by weight KCl and from 20 to 25% by weight $MgCl_2$. The most preferred composition is 80% KCl and 20% MgCl2, but this is difficult to manufacture. The composition may also advantageously contain small amounts of $CaF_2$. It is preferred that $CaF_2$ be present in no greater than about 1%, more preferably no more than about 0.5% by weight. No other species are added deliberately, however since magnesium chloride is being added there will likely be a small amount of magnesium oxide present, preferably in an amount no greater than 1% by weight. Most preferably the compositions of the present invention are substantially free of other materials. However, the compositions may contain the normal amounts of other impurities found in the materials commercially available to make the compositions of the present invention.

In preparing the compositions of the present invention, conventional fusing and grinding techniques as practiced by those skilled in the art of flux preparation may be employed. Manufacture of the flux by mixing the two species is not preferred. In fact, mixing may produce a detrimental flux due to the possible formation of non metallic inclusions in the produced ingots.

The compositions of the present invention are particularly well-suited as a flux for the production and casting of magnesium and magnesium-containing alloys. In such circumstances, the composition is added to an open vessel of molten metal by either the use of a shovel, an air conveying system or some sort of mechanical spreader, as is known in the art. The flux is also used in the transport of molten magnesium. In such circumstances the flux is preferably added as a solid to the top of molten magnesium in a transfer crucible.

The density of the composition of the present invention is less than or similar to that of molten magnesium so that when the composition is added to magnesium it will float on the surface. Furthermore, because typical interfacial tensions between the composition and molten magnesium is in the range of 300 to 450 dyne/cm (see Reding, J. N., "Interfacial Tensions Between Molten Magnesium and Salts of the $MgCl_w$-KCl-$BaCl_2$ System", *Journal of Chemical and Engineering Data*, Vol. 16, No 2. 1971 pp 190–105 and Partrov, B. V., Polous, V. A., Barannik, I. A., "Interfacial Tension Between Magnesium Alloys and Chloride-Fluoride Melts", *Zhurnal Prikladnoi Khimii*, Vol. 57. No 11, 1984, pp 2260–2262), the magnesium does not wet the flux well, helping to keep the two phases separate. Accordingly, the flux forms a molten barrier between air and the molten metal preventing oxidation of the metal. Thus, the flux can be used in any application where fire suppression is desired or necessary.

The following examples are representative of the novel compositions and their use as a flux.

EXAMPLE 1

A 5000 pound load of molten magnesium from a electrolytic smelter was pumped into a receiving pot at a temperature somewhat less than 700° C., probably around 680° C. Thirty kilograms of a fused mixture of 80% KCl and 20% $MgCl_2$ were added by shovel to the surface of the molten magnesium. A layer of 2–4 mm of flux was formed so that as it began to melt (directly upon addition) it quickly covered the whole surface of the metal. The magnesium metal was prevented from burning for 12 and a half minutes. Experiments conducted in the same pot with the same operating personnel demonstrated that the composition of the present invention prevented burning for more than 6 times as long as the commercial flux M-130.

EXAMPLE 2

Thirty four kilograms of a fused mixture of 80% KCl and 20% $MgCl_2$ were added to the surface of a 5000 pound pot of molten magnesium as in Example 1, and the magnesium metal was prevented from burning for four and one half hours.

EXAMPLES 3–4

Thirty kilograms of a fused mixture of 75% KCl, 25%$MgCl_2$ were added to the surface of a 5000 pound pot of molten magnesium as before. The molten magnesium was prevented from burning for 8 minutes.

This experiment was duplicated and the second experiment resulted in preventing the metal from burning for 32 minutes.

What is claimed is:

1. A composition of matter suitable for use as a flux for use in the production of magnesium or magnesium-containing alloys, the composition comprising 75 to 80 percent by weight KCl, and 20 to 30 percent by weight $MgCl_2$.

2. The composition of claim 1 wherein the $MGCl_2$ is present in an amount of from 20 to 25% by weight.

3. The composition of claim 1 further comprising up to 0.5 percent by weight $CaF_2$.

4. The composition of claim 1 wherein the material is fused.

5. A method of producing magnesium or magnesium-containing alloy comprising:

a. electrowinning magnesium metal from an electrolytic cell b. pumping the electrowon metal from the electrolytic cell to a molten metal transfer crucible;

c. transporting the molten metal transfer crucible containing the electrowon metal to a receiving pot;

d. transferring the electrowon metal from the molten metal crucible to the receiving pot;

e. optionally adding alloying ingredients into the receiving pot; and f. casting the metal into ingots;

characterized by the use of a flux comprising 70 to 80 percent by weight KCl and 20 to 30 percent by weight $MgCl_2$.

6. The method of claim 5 wherein the flux further comprises up to about 0.5 percent by weight $CaF_2$.

7. The method of claim 5 wherein the flux is fused.

8. The method of claim 5 wherein the flux comprises 75 to 80 percent by weight KCl.

9. The method of claim 5 wherein the flux comprises 20 to 25 percent by weight $MgCl_2$.

* * * * *